United States Patent [19]

Fiergolla et al.

[11] Patent Number: 4,586,307

[45] Date of Patent: May 6, 1986

[54] PREFABRICATED CEILING ELEMENT FOR CEILINGS IN BUILDINGS

[76] Inventors: Ulrich Fiergolla, Schillerstr. 8, (4992) Espelkamp; Josef Rottmayr, Eduard-Schmid-Str. 26, (8000) Muenchen 90, both of Fed. Rep. of Germany

[21] Appl. No.: 253,505

[22] PCT Filed: Jul. 18, 1980

[86] PCT No.: PCT/DE80/00104

§ 371 Date: Mar. 5, 1981

§ 102(e) Date: Mar. 5, 1981

[87] PCT Pub. No.: WO81/00272

PCT Pub. Date: Feb. 5, 1981

[30] Foreign Application Priority Data

Jul. 20, 1979 [DE] Fed. Rep. of Germany ..... 2929350

[51] Int. Cl.[4] ..... E04B 1/04; E04C 3/30

[52] U.S. Cl. ..... 52/334; 52/692; 52/602

[58] Field of Search ..... 52/723, 334, 333, 602, 52/690, 692, 694, 634–636

[56] References Cited

U.S. PATENT DOCUMENTS

| | | | |
|---|---|---|---|
| 1,725,501 | 8/1929 | Yeager | 52/690 |
| 1,804,132 | 5/1931 | Tashjian | 52/334 |
| 2,055,701 | 9/1936 | Palmer | 52/692 |
| 2,558,946 | 7/1951 | Fromson | 52/723 |
| 2,636,377 | 4/1953 | Hilpert | 52/334 |
| 2,987,855 | 6/1961 | Singleton et al. | 52/334 |
| 3,094,813 | 6/1963 | Saxe | 52/333 |
| 4,115,971 | 9/1978 | Varga | 52/334 |
| 4,196,558 | 4/1980 | Jungbluth | 52/723 |

FOREIGN PATENT DOCUMENTS

| | | | |
|---|---|---|---|
| 619536 | 5/1961 | Canada | 52/692 |
| 648462 | 9/1962 | Canada | 52/692 |
| 498281 | 1/1939 | United Kingdom | 52/636 |
| 586394 | 3/1947 | United Kingdom | 52/692 |
| 937440 | 4/1960 | United Kingdom | 52/334 |
| 925236 | 5/1963 | United Kingdom | 52/648 |
| 1117111 | 6/1968 | United Kingdom | 52/729 |

*Primary Examiner*—James L. Ridgill, Jr.
*Attorney, Agent, or Firm*—W. G. Fasse; D. H. Kane, Jr.

[57] ABSTRACT

A prefabricated ceiling element for ceilings in buildings comprises a concrete ceiling panel (1, 1′, 1″) and a steel girder (2, 2′, 2″) having a T-section, the web of which has tips (**2*c*, 2*c*′) which are anchored in the concrete ceiling panel (1, 1′, 1″). Free cutouts (2*d*) are located between the tips. The steel girder (2, 2′, 2″) extends only over the midportion of the ceiling panel (1, 1′, 1″), so that at the ends of the panel support areas and installation lanes (4**) remain freely accessible.

8 Claims, 8 Drawing Figures

PREFABRICATED CEILING ELEMENT FOR CEILINGS IN BUILDINGS

The invention relates to a prefabricated ceiling element for ceilings in buildings in accordance with the preamble of claim 1.

Different types of such ceilings are known. The steel girders of the known ceiling elements extend over the entire length of the ceiling element British Patent (GB-PS) No. 925 236; "Reference Sheet 115" of the Information Office for the Use of Steel, Duesseldorf, Page 15, DIN 1045.

These known ceiling elements and the building ceilings constructed of these elements all have the disadvantage that conduits to be installed at the construction sites must be passed through openings in the girders which requires a substantial expense for labor. Besides, the dimensions of such installation conduits are limited by the structural height.

It is the object of the invention to provide a prefabricated ceiling element for ceilings in buildings in which any installation conduits may be freely installed from below. Stated differently, it is the purpose to leave installation zones or lanes free along which all points of the ceiling may be reached. Further, the structural height shall not limit the diameter of the installation conduits and the material expense for the production shall be kept minimal.

These objectives are achieved by the features recited in the characterizing clause of claim 1.

The ceiling element, according to the invention, is placed with each of its ends which are free of the steel girder onto a support, for example, the upper edge of a supporting wall. Due to the spacing between the ends of the steel girder and the short side, there remains a free space between the inner surface of the support and the adjacent end of the steel girder extending in the longitudinal direction of the ceiling element. Thus, in this area an installation lane is provided extending across the longitudinal direction of the ceiling element and of the respective steel girder. Installation lanes or zones also remain free between the steel girders extending in the longitudinal direction. These installation lanes or zones are freely accessible from below when the ceiling has been installed so that any desired installation conduits may be installed without any problems.

The structural height of the ceiling may be selected to be minimal without limiting the permissable diameter of installation conduits to be installed. Similarly, the material expense may be minimized because the ceiling comprises substantially only the relatively thin concrete ceiling panel and the girder provided with many cutouts.

The steel girder of a known ceiling element (GB-PS 925 236) used to have the form of a lattice girder; however, instead the types characterized in claims 2 and 3 are presently preferred.

Different possibilities are also available for anchoring the tips of the steel girder web. The possibility characterized in claim 4 provides for a simple manufacturing of the girder itself in combination with an acceptable expense for the manufacturing of the ceiling element.

In the embodiment of the invention according to claim 5, however, the insertion of the concrete ceiling panel reinforcement is even simpler because even the crosswise extending reinforcing irons may first be placed into the molds for the concrete ceiling panel whereupon the steel girders with their tips may be inserted into this mold whereby the headed bolt dowels are pushed in between the reinforcing irons. However, the expense of manufacturing the steel girders themselves is substantially higher. Additionally, it is difficult to transport such steel girders separately because these girders are relatively unstable prior to being anchored in the concrete ceiling panel.

When the ceiling elements, according to the invention, are prefabricated, it is generally not possible to use steel girders having a length adjusted to the desired length of the ceiling elements. Stated differently, it is not possible to use such girders in which the spacings between the steel girder web tips have been so dimensioned so that it would be possible to anchor a tip in the concrete ceiling panel respectively at the desired spacing from the short ends of the concrete ceiling panel. In a known ceiling element (GB-PS No. 925 236) a tension element extending at an acute angle to the concrete ceiling panel is anchored with its free end in the concrete ceiling panel at the respective end of the steel girder. This construction is modified according to the characterizing features of claim 6 in a ceiling element according to the invention whereby the special embodiments are characterized in claims 7 and 8.

The invention will be described in more detail with reference to the drawing, wherein.

Figure 1:
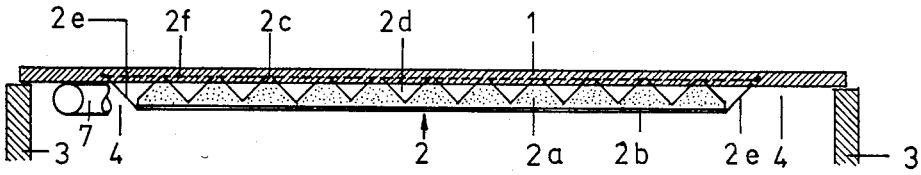
FIG. 1 is a longitudinal section through a ceiling element after it has been placed onto supports.
Figure 2:
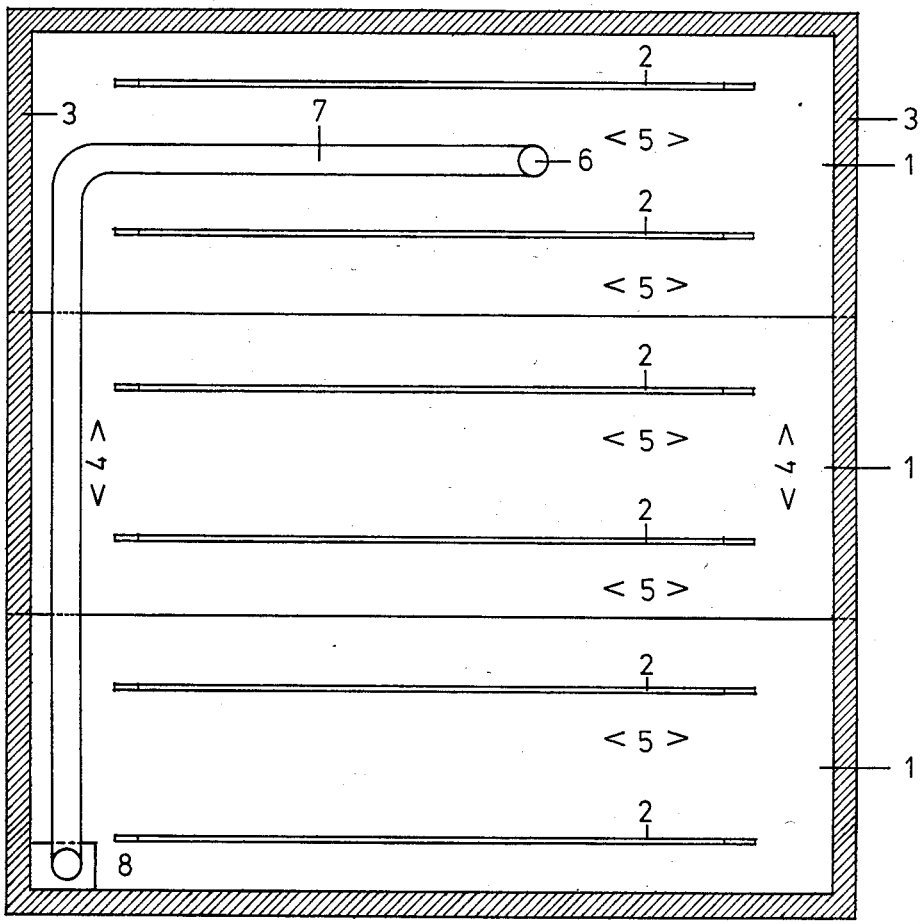
FIG. 2 is a view from below against a building ceiling comprising three ceiling elements according to FIG. 1.

FIGS. 1 and 2 illustrate a steel concrete ceiling comprising three ceiling elements. Each ceiling element comprises a steel reinforced concrete ceiling panel 1 forming an upper chord and two steel girders 2 arranged on the downwardly facing side of the ceiling panel 1. Each of these steel girders 2 comprises a web plate **2*a* and a lower chord forming flange 2*b*. Each webplate 2*a* is cut straight on its side facing downwardly and cut into a zig-zag shape on its side facing upwardly as shown in FIG. 1. The zig-zag cut is such that tips such as 2*c* are formed between which there are provided cutouts such as 2*d*. Such a cut may be made in such a manner that two sheet metal webs such as 2*a* are formed which are equal to each other when cutting a sheet metal strip of the desired width or a flat steel of a corresponding width. The flange 2*b* is welded to the straight side of the sheet metal web 2*a* to form said lower chord. The two ends 2*e* extend beyond the sheet metal web 2*a* at an angle of 45° toward the plane of the upper chord forming ceiling panel 1 where they are anchored. In the illustrated embodiment the anchoring is accomplished by means of two round steel rods, one of which is shown at 2*f*. The round steel rods are welded to the free ends of the flange members 2*e* as well as to each of the tips 2*c***.

The spacing between the free ends of the flange members 2e and the narrow sides or edges of the concrete ceiling panel 1 is visibly larger than the structural height of the ceiling element itself. Stated differently, the sum of the thickness of the ceiling panel 1 and the free height of the steel girder 2 is smaller than said spacing. The upper limit for this spacing is determined by the bending stress capacity of the ceiling panel 1.

Figure 3:
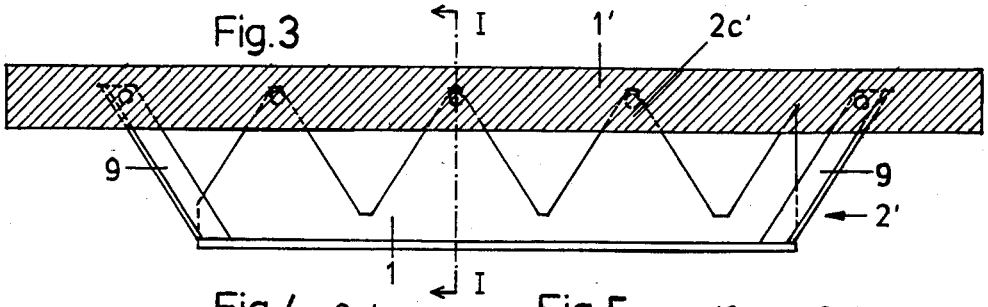
FIG. 3 shows the details of a second embodiment of a ceiling element according to the invention.

The ceiling panels 1, as best seen in FIG. 1, are placed on supports 3 adjacent to their short sides or edges. In the shown example embodiment, the supports are the upper edges of two supporting walls. The securing at this point is conventional. As shown, the above mentioned spacing provides an intermediate space which remains free between the inwardly facing sides of the walls 3 and the ends 2e of the steel girder 2 so that, as best seen in FIG. 2, an installation zone or lane 4 is provided which is freely accessible from below. Further, as clearly shown in FIGS. 1 and 3 the ends of the panel 1 above the zones 4 are completely free of the steel girders 2 so that the girder ends 2e in FIG. 1 or the T-sections 9 in FIG. 3 are spaced from the supports 3. After installing the ceiling an opening 6 in the ceiling may be connected with a vertical installation conduit 8 through a conduit 7 which may have, as best seen in FIG. 1, a diameter of any desired size without changing the structural height of the ceiling. The conduit 7 may extend through an installation zone or lane 5 between the steel girders 2 as also illustrated in FIG. 2. The installation zone or lane 5 remains free between the steel girders 2. Installation conduits of smaller diameter may be inserted through the cutouts 2d between the tips 2c of the steel girders 2 in a manner not shown whereby under certain circumstances it may be possible to shorten the total conduit length.

With regard to the mechanical load capacity, the ceiling element according to the invention functions in its central zone as a compound beam which means that the concrete ceiling panel 1 takes up pressure forces or compression stress in the upper chord while the steel girder 2 forming the lower chord takes up tension stress as well as shearing stress between the tension chord and the pressure chord. In the area of the installation zone or lane 4 all forces, that is, all stresses including bending stresses are taken up only by the concrete ceiling panel and especially by the reinforcement embedded in the ceiling panel. These stresses are then introduced at the spacing from the supports 3 into the flange 2b of the steel girder 2 through the flange ends 2e.

When manufacturing a ceiling element according to FIGS. 1 and 2, one proceeds in such a manner that after welding the flange 2b to the sheet metal web 2a, the two round steel rods 2f are welded to the flange ends 2e and to the web tips 2c. A ceiling panel mold is then prepared to the extent that the longitudinal reinforcement is inserted and that the cross reinforcement is inserted into the upper portion of the ceiling panel 1. Thereafter, the girder 2 is inserted as illustrated in such a manner that the tips 2c penetrate approximately half way into the mold. Thereafter, the cross reinforcements in the upper portion of the ceiling are pushed through the cutout between the tips 2c whereupon the concrete is poured into the mold in a conventional manner.

Figure 4:
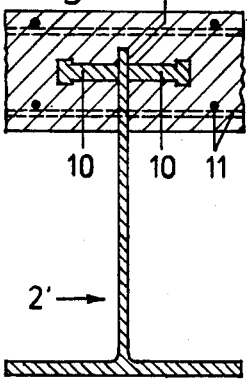
FIG. 4 is a section along line I—I in FIG. 3.
Figure 5:
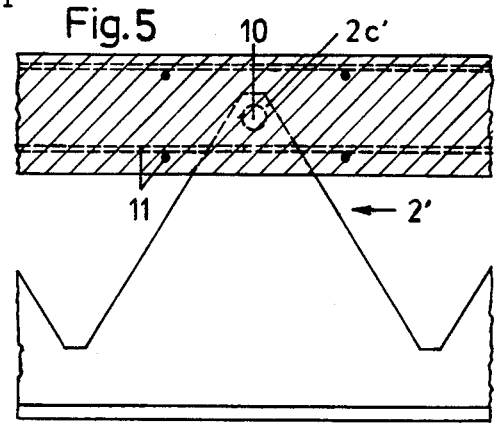
FIG. 5 is a detail of the embodiment according to FIG. 3.

In the embodiment, according to FIGS. 3 to 5, there is also provided a ceiling panel 1' as well as a steel girder 2' which, however, in this embodiment is one-half of an I-beam, the web of which has been cut open in a zig-zag shape so that again the tips 2c' are produced between which cutouts remain open. Two T-sections 9 are welded to the two ends of the steel girder 2'. The T-sections 9 extend approximately at an angle of 45° to the ceiling panel 1'. Headed bolt dowels 10 are welded to the tips 2c' and to the free ends of the sections 9 respectively.

In this embodiment, the manufacturing of the ceiling element proper takes place in a manner analogous to the fabrication of the embodiment according to FIGS. 1 and 2. However, in this embodiment it is possible to insert all reinforcement iron for the ceiling panel 1' into the ceiling panel mold as shown at 11 in FIGS. 4 and 5 before the girder with its tips 2c' and with the headed bolt dowels 10 welded thereto is inserted into the mold. This is possible because the headed bolt dowels 10 fit without problem between the crosswise extending reinforcing irons as best is seen in FIG. 4.

Figure 6:
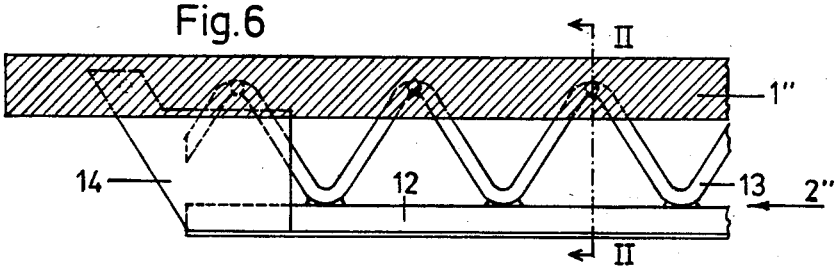
FIG. 6 is a partial section similar to that of FIG. 3 through a third embodiment of the invention.
Figure 7:
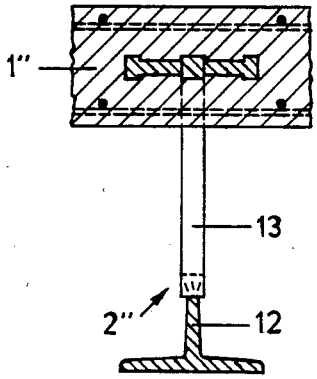
FIG. 7 is a section along the section line II—II in FIG. 6.
Figure 8:
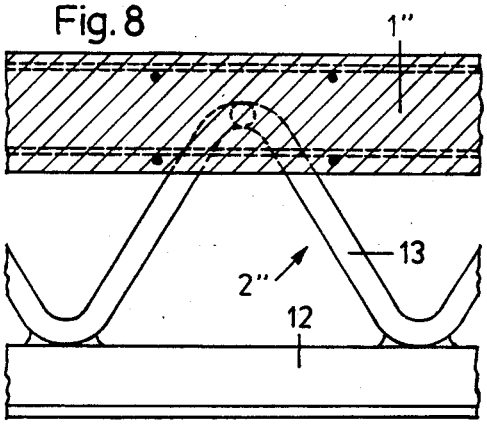
FIG. 8 is a detail of a ceiling element according to FIG. 6.

The embodiment according to FIGS. 6 to 8 differs from that of FIGS. 3 to 5 in two aspects. The steel girder 2' comprises in this embodiment a T-section 12 and a round steel bar 13 welded to the upper edge of the web of the T-section 12. The round steel 13 has been bent into a zig-zag shape as shown. In all other respects the construction is the same as that of the steel girder 2' of the embodiment according to FIGS. 3 to 5. Web plates 14 are provided in this embodiment at the ends, one of which is shown in FIG. 6. The web plates 14 are welded to the T-section 12. Additionally, the web plates may also be welded to the round steel rod 13. The side of the web plate 14 facing away from the steel girder 2' extends at an angle of 45° to the ceiling panel 1''. The web plates 14 are anchored in the ceiling panel 1'' in the same manner as in the embodiment according to FIGS. 3 to 5.

Other possibilities for anchoring the tips 2c, 2c' of the steel girders 2, 2' and 2'', as well as the respective ends 2e, 9, or 14 in the ceiling panel 1, 1', or 1'' are well known and it is therefore not necessary to describe them in more detail. For example, the anchorings by means of headed bolt dowels may be reinforced by means of a steel wire coil.

It has already been mentioned that conduits may be guided through the cutouts between the web tips 2c and so forth in order to shorten the length of the conduits. This feature even applies if, as is required for larger ceiling openings for stairs, elevators, shafts, and so forth, exchangeable girders must be used. These exchangeable girders may be connected at any point of the steel girder 2 or 2'' because the remaining web transmits the force to be introduced from any point to the respective junction. In the embodiment according to FIGS. 6 to 8, the same purpose is achieved in that a web plate having the length of one wave of the zig-zag shaped round iron rod 13, is secured in the zone of the connecting point of the exchangeable girder. This web plate transmits the force of the exchangeable girder into the junctions of the steel girder 2, 2''. However, it is also possible to insert the exchangeable girders into the cutouts, such as 2d, in the same manner as one would insert conduits.

We claim:

1. In a prefabricated ceiling element for ceilings in buildings, having a concrete ceiling panel with reinforcing rods embedded in said concrete ceiling panel which has a substantially uniform thickness throughout its given length and at least one steel girder extending in the longitudinal direction of the ceiling panel, said steel girder having a T-cross-section with a web having projecting tips and substantially triangular cutouts between the tips so that the tips of the steel girder webs are anchored in the concrete ceiling panel, said steel girder having a given height below the ceiling panel so that the thickness of said ceiling panel plus the given height of the steel girder make up the structural height of the ceiling element, the improvement comprising a steel girder length, which extends in the longitudinal direction of said concrete ceiling panel, said steel girder length being shorter than said given length of said concrete ceiling panel whereby a spacing is provided between each of the short ends of the concrete ceiling panel and each respective end of said steel girder, each said spacing being bridged by a panel end portion having a length in said longitudinal direction corresponding at least to said entire structural height of the ceiling element, and wherein the concrete ceiling panel end portions with the reinforcing rods embedded therein are completely free of any portions of said steel girder, said panel end portions bridging an installation zone in which all forces are taken up by the concrete ceiling panel and said reinforcing rods embedded therein.

2. The ceiling element of claim 1, wherein the steel girder comprises one half of an I-sectional beam which has been divided by a cut extending in zig-zag form through the web of the beam.

3. The ceiling element of claim 1, wherein the steel girder comprises a sheet metal member, one side of which has been cut to form a zig-zag shape and the other side of which has been cut straight, and a flange welded to the straight side, said flange extending substantially perpendicularly to said straight side.

4. The ceiling element of claim 1, wherein the tips of the steel girder are connected to at least one steel rod and wherein the tips with the steel rod are anchored in the concrete ceiling panel.

5. The ceiling panel of claim 1, wherein the tips of the steel girder are anchored in the concrete ceiling panel by means of headed bolt dowels.

6. The ceiling panel of claim 1, further comprising a tension element secured at each end of the steel girder, said tension element extending at an acute angle to the concrete ceiling panel, and the free end of which is anchored in the ceiling panel, said free end of the tension element being spaced from the short ends of the concrete ceiling panel to also provide a spacing between the short ends and the tension element corresponding to at least the entire structural height of the ceiling panel.

7. The ceiling panel of claim 6, wherein the tension element is a T-section.

8. The ceiling panel of claim 6, wherein the tension element is a sheet metal web.

* * * * *